United States Patent [19]

Stearns, IV

[11] Patent Number: 5,074,234

[45] Date of Patent: Dec. 24, 1991

[54] VORTEX GENERATORS FOR SAILS

[76] Inventor: Richard I. Stearns, IV, 1029 Elmwood Ave., Wilmette, Ill. 60091

[21] Appl. No.: 513,387

[22] Filed: Apr. 23, 1990

[51] Int. Cl.[5] ..... B63H 9/04

[52] U.S. Cl. ..... 114/103; 244/199

[58] Field of Search ..... 114/102, 103, 39.1, 114/90; 244/199, 200

[56] References Cited

U.S. PATENT DOCUMENTS

| | | | |
|---|---|---|---|
| 1,152,426 | 9/1915 | McCarroll | 244/200 |
| 4,223,631 | 9/1980 | Poad | 114/103 |
| 4,696,442 | 9/1987 | Mazzitelli | 244/199 |
| 4,729,331 | 3/1988 | Eggleston | 114/294 |

FOREIGN PATENT DOCUMENTS

| | | | |
|---|---|---|---|
| 3110513 | 10/1982 | Fed. Rep. of Germany | 114/90 |
| 47294 | 4/1977 | Japan | 114/103 |

*Primary Examiner*—Sherman Basinger
*Assistant Examiner*—Thomas I. Brahan
*Attorney, Agent, or Firm*—Quarles & Brady

[57] ABSTRACT

A vortex generator for attachment to the surface of a sail of a sailboat made from a strip of foldable material such as sail cloth or film that has a central member formed of two panels of the strip joined together by pressure sensitive adhesive and a foot panel extending from each side of the central member and having pressure sensitive adhesive on a surface thereof by which each foot panel is adhered to a surface of the sail.

1 Claim, 2 Drawing Sheets

Fig. 1
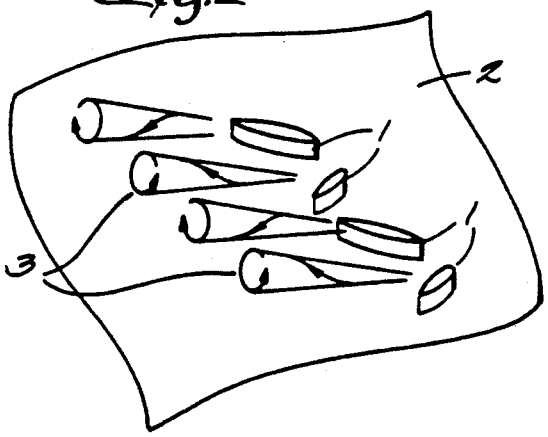
Fig. 2
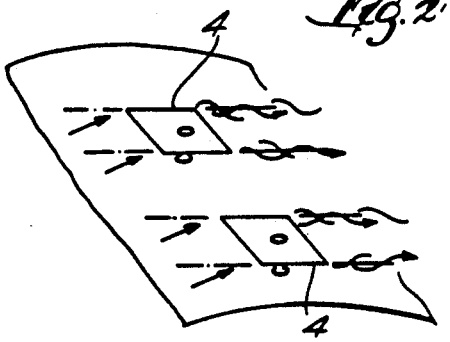
Fig. 3
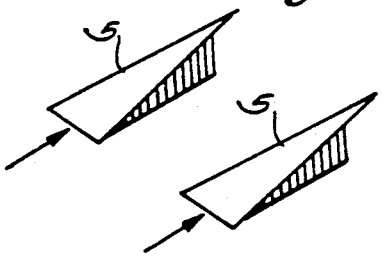
Fig. 4
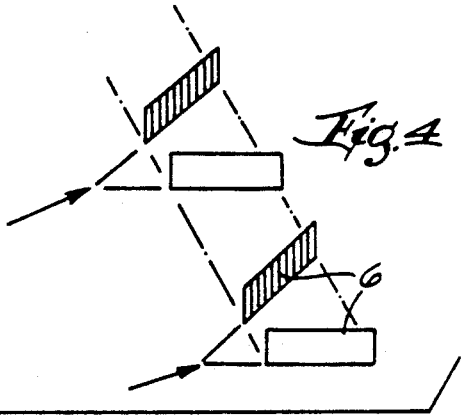
PRIOR ART
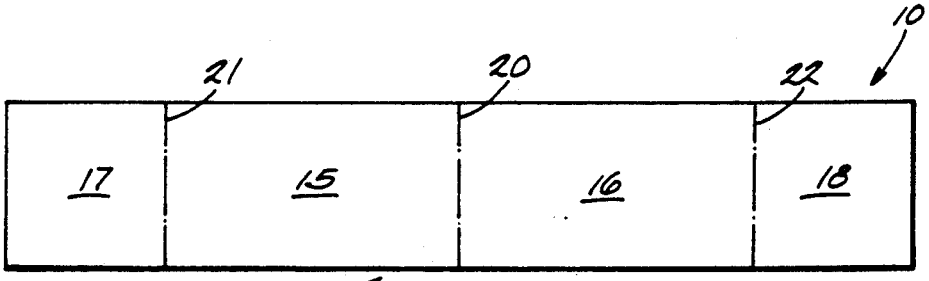
Fig. 5
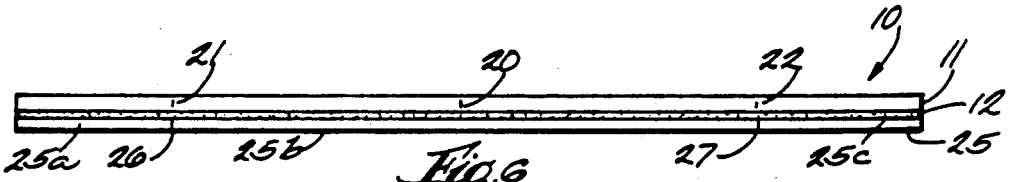
Fig. 6
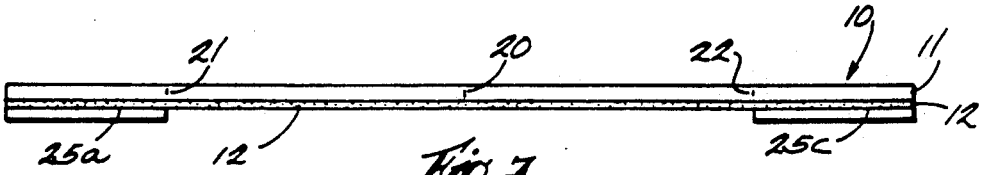
Fig. 7

VORTEX GENERATORS FOR SAILS

FIELD OF THE INVENTION

The present invention relates to new and economical constructions for vortex generators to be attached to a sail in order to improve the flow of air about the sail.

BACKGROUND ART

The sail of a boat sailing at a angle of incidence to the true wind develops lift and drag forces by reason of the flow of air about the airfoil shape of the sail. The air flow is such that low pressure is established along the leeward (convex) side of the sail and high pressure along its windward (concave) side, which, as now generally propounded by theorists in the field, produces circulation of air about the sail, or a bound vortex, which results in the lift and drag forces. The total lift is represented as a lift vector that is perpendicular to the direction of the relative wind and the drag as a drag vector that is parallel to the direction of the relative wind. The total aerodynamic force is the resultant, acting at the center of pressure of the sail, of the lift and drag forces and can be resolved into a thrust vector that is parallel to the heading of the boat and propels the boat forward and a heeling force that is perpendicular to the heading of the boat that is responsible for heeling the boat to leeward. The underwater foils of the boat, either a keel or centerboard and the rudder, develop equal and opposite hydrodynamic forces since they act at an angle of incidence to the flow of water about their surfaces.

As noted above, the aerodynamic force developed by a sail is a result of the pressure differential between the windward surface of the sail (high pressure) and the leeward surface of the sail (low pressure). The pressure differences vary along the sail foil, being greatest along the forward section of the sail. The effectiveness of a sail is primarily dependent on the character and quality of the air flow over its leeward surface, especially along its forward portion. The air flow is laminar over the forward part of the leeward surface, but then changes to turbulent flow and separates from the sail along a transition zone. The location of the transition zone varies with the angle of incidence between the sail and the wind, and is generally thought to be in the range from about 1/10 to ⅓ of the foil length behind the leading edge of the sail. The effectiveness of the sail is decreased when the air flow separates from the sail, and the lift generated by the sail can be increased if the separation can be delayed or moved aft along the sail.

One of the techniques taught in the art for delaying air flow separation is the use of vortex generators to develop tip vortices that act to drag in air from the free air stream beyond the very thin boundary layer next to the surface of the sail to energize the air in the boundary layer so as to delay separation and improve the lift-to-drag ration of the aerodynamic forces. Various constructions for vortex generators have been suggested or proposed, as described later in this specification. The principal objective of the present invention is to provide a simple, economical construction for vortex generators which, it is believed, will enable substantially more widespread use of the device by sailors.

SUMMARY OF THE INVENTION

A vortex generator of my present invention comprises a vertical central member and a foot panel on each side of the central section; the foot panels each have a layer of pressure sensitive adhesive on their bottom surface by means of which the vortex generator is attached to a sail. A number of the vortex generators are attached to both surfaces of a sail, and an important advantage of the new construction is that this can be done at reasonable expense and without any special tools or equipment.

DESCRIPTION OF THE DRAWINGS

The present invention is described in full and enabling detail by reference to the accompanying drawings, in which:

FIG. 1 illustrates a prior art vortex generator;

FIG. 2 illustrates another prior art vortex generator;

FIG. 3 illustrates a third prior art vortex generator;

FIG. 4 illustrates a fourth prior art generator;

FIG. 5 is a plan view of a foldable strip for a vortex generator of the invention;

FIG. 6 is a side view of the foldable strip of FIG. 5;

FIG. 7 is a side view of the foldable strip of FIGS. 5 and 6 in an intermediate condition;

DESCRIPTION OF PREFERRED EMBODIMENTS

(a) Prior Art

Figure 8:
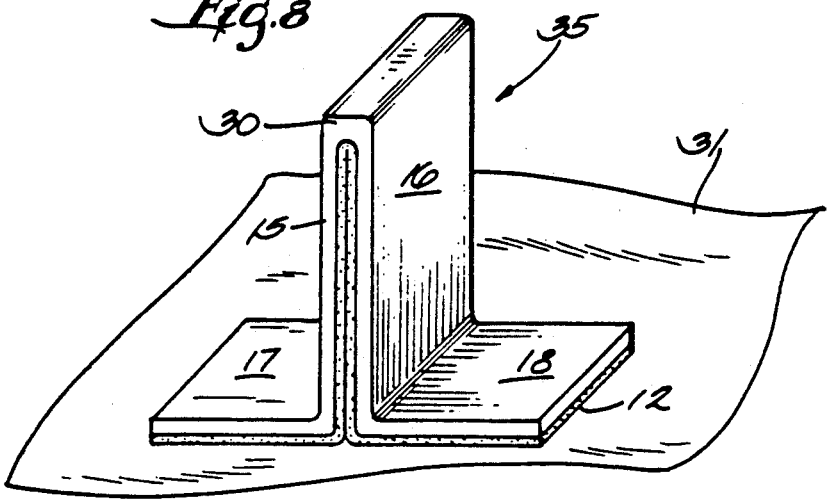
FIG. 8 is a perspective view of a vortex generator of the invention as formed from the strip of FIGS. 5–7.

FIG. 1 illustrates a group of four prior art vortex generators 1 attached to a section of a sail 2. The drawing is adapted from an illustration from *The Design of Sailing Yachts,* Gutelle, Macmillian London Ltd., 1984. The book describes the generators as being arranged at alternate angles in a row. FIG. 1 also shows tip vortices 3 which are developed by the vortex generators and result in their beneficial effect on sail performance. The treatise *Aero-Hydrodynamics of Sailing,* March, 1979 edition, illustrates several types of vortex generators and FIGS. 2–4 reproduce drawings from the book. FIG. 2 illustrates a wing type device 4, FIG. 3 a ramp device 5 and FIG. 4 a vane type of vortex generator 6. Vortex generators 1,4 and 5 are three-dimensional structures of rather complicated configuration and probably would have to be made of molded plastic, which would be quite expensive and present problems of attaching them to a sail. Vortex generator 1 is illustrated in the book as being on a wing section, and it is not clear whether it was tried on sails. The book from which FIG. 4 was taken does not give any indication as to the manner in which vortex generator 6 is or can be attached to a sail.

Thus, although the prior art teaches the potential beneficial effect of vortex generators for sails, it does not teach a practical construction that is not only effective but also economical and easy to attach to a sail.

(b) Vortex Generators of the Invention

A foldable strip 10 is shown in FIGS. 5–7 that comprises a blank that will be folded and two of its panels joined together to form a vortex generator of the present invention. Foldable strip 10 is a rectangular element comprising a substrate 11 and a layer of pressure sensitive adhesive 12 on one surface of the substrate. Strip 10 includes four panels: a first central panel 15, a second central panel 16 adjacent panel 15, a foot panel 17 adjacent central panel 15, and a foot panel 18 adjacent central panel 16. Strip 10 is divided into panels 15–18 by three spaced parallel transverse fold lines 20, 21 and 22. Fold line 20 preferably is located at the center of strip 10, fold line 21 is spaced from fold line 20 a distance selected for the length of central panel 15, and fold line 22 is preferably located the same distance from fold line 20 but on its opposite side so that central panel 16 is of the same length as panel 15. Fold lines 21 and 22 also are spaced from the ends of strip 10 a distance sufficient to define foot panels 17 and 18 of the selected length. Strip 10 may be of almost any selected size, but generally can be in the range of 2 to 6 inches long and ½ to 2 inches wide; as a nonlimiting example, a strip 10 that is 4 inches long and 2 inches wide with transverse fold lines 20–22 located 1 inch apart to provide panels 15–18 that are each 1 inch long is suitable for many sizes of sails.

Strip 10 is most usefully made of one of the adhesive coated materials typically used for sailmaking. Polyester fabrics such as Dacron®, laminates of polyester fabric and polyester film such as Mylar®, laminates of Kevlar® fabric and polyester film, and polyester film, each having a layer of pressure sensitive adhesive along one surface, are useful materials inasmuch as they are readily available to all sailmakers at reasonable cost and are flexible so as to be easily folded into the vortex generators of the present invention.

In the condition of FIG. 6, a release liner 25 covers and protects pressure sensitive adhesive layer 12 until the strip 10 is to be folded into a vortex generator and attached to a sail. Liner 25 is divided into a first section **25*a* under foot panel 17, second section 25*b* under central panels 15 and 16, and third section 25*c* under foot panel 18 by means of separable lines of weakness 26 and 27 formed in the liner under, respectively, fold lines 21 and 22. The liner is separable into sections 25*a*–25*c* along the lines of weakness 26 and 27**, which may comprise slits, perforations or score lines formed in the liner.

When a strip 10 is to be folded into a vortex generator, the first step, see now FIG. 7, is to remove section **25*b* of the liner from under central panels 15 and 16 so as to expose the pressure sensitive adhesive on the bottom surface of the two panels. Next, strip 10 is folded along fold line 20 and the adhesive under panel 15 is joined to the adhesive under panel 16 to thereby combine the panels into a central member 30. Turning to FIG. 8, section 25*a* of the liner is removed from foot panel 17 and section 25*c* of the liner is removed from foot panel 18, and the two foot panels are adhered to a said 31 along the portion of adhesive layer 12 on the bottom surface of each foot panel. This provides a vortex generator 35 consisting of central member 30 projecting from the sail into the airstream so as to develop a tip vortex and foot panels on each side of central member 30 for attaching the vortex generator 35** to the sail quickly and easily.

Figure 9:
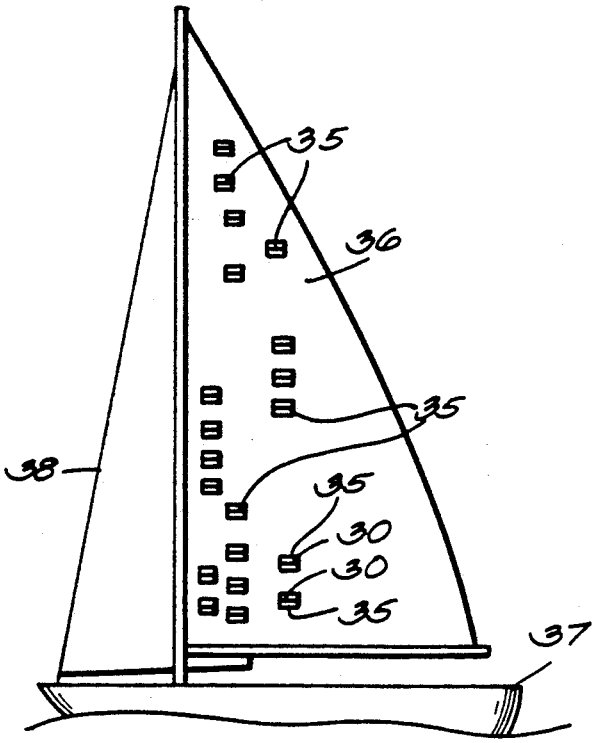
FIG. 9 is a schematic side view of a boat with a plurality of vortex generators of the invention attached to a sail.
Figure 10:
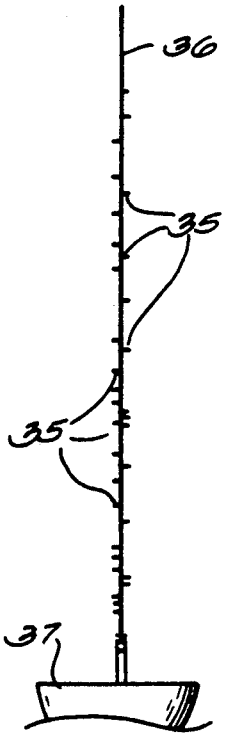
FIG. 10 is an end view of the boat of FIG. 9.

FIGS. 9 and 10 are schematic illustrations of a plurality of vortex generators 35 installed on the mainsail 36 of a sailboat 37. As shown in FIG. 9, the vortex generators 35 are adhered to the sail 36 with the central member 30 of the vortex generators generally aligned along the luff-leach direction of the sail. Each vortex generator 35 is attached to the sail in the manner illustrated in FIG. 8. The vortex generators are shown as organized generally into three vertical rows along the forward portion of the sail. However, it is believed that it is not necessary for the vortex generators to be aligned in any specific manner relative to one another and that random arrangement and alignment of the vortex generators along each surface of the sail is all that is necessary for efficient action. I have found it is preferable to attach the vortex generators to the sail along the forward 1/10 to ⅓ of the chord length of the foil. Many arrangements of vortex generators on the sail are possible, and it is usually necessary to experiment with several locations on any specific sail for a particular boat in order to find the most effective positioning of the vortex generators; another advantage of the vortex generators of the invention is that they can be easily applied to a sail and also easily removed so that testing various arrangements and positions of the vortex generator can be handled in a facile manner with the new vortex generators of the invention. As illustrated in the schematic view of FIG. 10, vortex generators 35 are attached to both surfaces of the sail 36 so that they can function regardless of the tack that the sailboat is on, bearing in mind that it is the vortex generators on the leeward surface of the sail that have the beneficial effect on reducing separation of air flow. Although the vortex generators are shown as being installed on the mainsail 36 of boat 37 in FIGS. 9 and 10, they also can be effectively applied to a headsail such as jib 38 of the boat or a spinnaker or staysail.

The foregoing detailed description provides sailors with a novel vortex generator that is economical in cost, readily attached to a sail, and easily removed from a sail, so that it is now possible for sailors of large and small boats to test the effectiveness of vortex generators on the ails of their particular boat without requiring modifications of a sail or the expenditure of large sums of money. The new vortex generators of the invention thereby obviate problems and disadvantages associated with prior art vortex generators, such as those described previously in connection with FIGS. 1–4. My new vortex generator has been described hereinabove by reference to certain presently-preferred embodiments, but it is anticipated that sailmakers and others of ordinary skill in the art of sailboats can devise modifications to the described embodiments that will remain within the true spirit and scope of the present invention.

I claim:

1. A blank to be folded into a vortex generator for attachment to the surface of the sail of a sailboat comprising a strip consisting of a substrate of said material, being foldable into four panels including first and second central panels adjacent each other, a first foot panel adjacent the first central panel, and a second foot panel adjacent the second central panel, a layer of pressure sensitive adhesive on one surface of the central panels and the foot panels, wherein the first and second central panels are adapted to be joined together by the pressure sensitive adhesive along their one surface to form a central member of the vortex generator, the foot panels are adapted to be joined to the surface of the sail by the pressure sensitive adhesive along their one surface, with the central member of the vortex generator projecting into the flow of air along the surface of the sail to which the vortex generator is attached wherein:

the blank is a rectangular element divided into the two central panels and the two foot panels and includes a release liner over the pressure sensitive adhesive on the one surface of the central panels and the foot panels, a first line of weakness defined in the liner between the first foot panel and the first central panel, and a second line of weakness defined in the liner between the second foot panel and the second central panel, wherein the liner is separable along the lines of weakness into a first section under the first foot panel, a second section under the first and second central panels and a third section under the second foot panel.

* * * * *